US008267249B2

(12) United States Patent
Cardinal et al.

(10) Patent No.: US 8,267,249 B2
(45) Date of Patent: Sep. 18, 2012

(54) FORWARD LEANING STORAGE AND DISPENSING BOX

(75) Inventors: Keith Cardinal, Gilbert, AZ (US); Mark Snyker, Skokie, IL (US); Dan Perez, Chicago, IL (US); Susan Ng Williams, Phoenix, AZ (US)

(73) Assignee: The Dial Corporation, Scottsdale, AZ (US)

( * ) Notice: Subject to any disclaimer, the term of this patent is extended or adjusted under 35 U.S.C. 154(b) by 302 days.

(21) Appl. No.: 12/404,536

(22) Filed: Mar. 16, 2009

(65) Prior Publication Data

US 2010/0230432 A1 Sep. 16, 2010

(51) Int. Cl.
*B65D 83/08* (2006.01)

(52) U.S. Cl. ..... 206/449; 206/425; 220/558

(58) Field of Classification Search ..... 206/449, 206/233, 494, 812, 823, 776, 215, 525, 526, 206/425, 39; 220/558, 810, 254.1, 254.3, 220/324; 221/47, 63, 34, 45, 48, 281, 285, 221/306

See application file for complete search history.

(56) References Cited

U.S. PATENT DOCUMENTS

| | | | | | |
|---|---|---|---|---|---|
| 1,692,463 | A | * | 11/1928 | Merrin | 221/34 |
| 4,030,596 | A | | 6/1977 | Snyder et al. | |
| 4,382,514 | A | | 5/1983 | Williams | |
| 4,382,526 | A | | 5/1983 | Stone | |
| 4,433,778 | A | | 2/1984 | Maio et al. | |
| 4,546,898 | A | | 10/1985 | Ekuan | |
| 4,645,077 | A | | 2/1987 | McLaughlin et al. | |
| 4,696,397 | A | | 9/1987 | Nakamats | |
| 4,735,309 | A | | 4/1988 | Nemeth | |
| 4,766,999 | A | | 8/1988 | Kin-Shon | |
| 4,778,048 | A | * | 10/1988 | Kaspar et al. | 206/205 |
| 4,986,415 | A | | 1/1991 | Posso | |
| 5,289,943 | A | | 3/1994 | Powell | |
| 5,629,527 | A | * | 5/1997 | Levitt et al. | 250/455.11 |
| 5,823,331 | A | | 10/1998 | Manservigi et al. | |
| 5,862,980 | A | * | 1/1999 | Samuelson | 229/104 |
| 6,929,120 | B2 | * | 8/2005 | Zonker et al. | 206/268 |
| 7,055,690 | B1 | * | 6/2006 | Valdez et al. | 206/449 |
| 7,124,909 | B1 | | 10/2006 | Armato | |
| 7,175,022 | B2 | | 2/2007 | Ito | |
| 7,207,461 | B2 | * | 4/2007 | Mitchell et al. | 221/45 |
| 7,559,434 | B2 | * | 7/2009 | Masting | 221/34 |
| 2001/0022276 | A1 | * | 9/2001 | Freiborg et al. | 206/323 |
| 2002/0108962 | A1 | * | 8/2002 | Mangin | 221/63 |
| 2006/0289555 | A1 | * | 12/2006 | Tsai | 221/45 |
| 2007/0034630 | A1 | * | 2/2007 | Lancesseur et al. | 220/281 |
| 2008/0135440 | A1 | | 6/2008 | Antal et al. | |
| 2008/0223748 | A1 | * | 9/2008 | Fried | 206/526 |
| 2009/0194555 | A1 | * | 8/2009 | Hoefing et al. | 221/63 |
| 2009/0234346 | A1 | * | 9/2009 | McBride et al. | 606/25 |
| 2010/0032445 | A1 | * | 2/2010 | Bunoz | 221/45 |

* cited by examiner

*Primary Examiner* — J. Gregory Pickett
*Assistant Examiner* — Robert Poon
(74) *Attorney, Agent, or Firm* — Paul A. Pappalardo

(57) ABSTRACT

A forward leaning, hinged-lid storage and dispensing box is described, suitable for use with flat, stacked articles such as index or playing cards, dry stiff articles and pads such as cleaning or burnishing pads, or the like. Minimally the box of the present invention comprises in combination; a back panel; side panels; a bottom panel; a front panel; a top panel; and, a lid hinged to the front panel that forms at least a portion of both the front and top panels of the closed box, and wherein the lid drops and opens forward on at least one hinged connection, and wherein the front panel is angled forward from vertical at least a few degrees. In this way, stacked flat articles loaded into the box will necessarily lean against and parallel to the inside surface of the front wall, ready for easy reach and removal one-at-a-time by the consumer.

1 Claim, 10 Drawing Sheets

FORWARD LEANING STORAGE AND DISPENSING BOX

FIELD OF INVENTION

The present invention relates to hinged-lid storage and dispensing boxes suitable for use with flat, substantially thin, sheet-like articles such as index or playing cards, dry pads such as cleaning or burnishing pads, and the like.

BACKGROUND

Hinged-lid boxes, suitable for containing flat, substantially thin articles such as index cards in a stacked upright (face-to-face) orientation are well known in both the patent literature and in the consumer marketplace. From very early beginnings as thin metal index card file boxes (U.S. Pat. No. 1,340,034 to Fosberg is exemplary), a plethora of new designs for hinged-lid storage and dispensing boxes for flat articles came into existence around the time of the computer diskette. The earliest versions of dispensing boxes for diskettes and similar flat articles included both "dropdown/forward opening" hinged-lid boxes and "backward opening" hinged-lid boxes, where in either embodiment the stacked contents are exposed when the box is opened. When the 3½ inch diskettes became popular, some forward opening boxes appeared wherein the lid, once opened, served as a tray for holding additional diskettes. The evolution of box designs for small flat items such as index cards and computer media also included other materials besides metal for their construction, namely paperboard (e.g. for new/blank media) and molded plastic (e.g. for recorded media requiring indexing). Paperboard hinged-lid boxes are also commonly used for cigarette packs, (U.S. Pat. No. 5,823,331 to Manservigi, et al. being exemplary). Although both diskette boxes and cigarette boxes may feature either forward or backward hinging/opening lids, the cigarette boxes have tended to be mostly backward hinging, by tradition and to allow exposure of more of the front of the cigarette including the brand logo when the box is open. Certainly with the further evolution of computer media from magnetic diskettes to laser read optical discs (compact discs, or "CD's"); the need to develop even more clever boxes that can dispense/index stacked articles was gone, since the side-by-side stacking of blank/writable CD's or recorded/indexed CD's would cause undue scratching unless they are sleeved. Consequently, boxes for flat discs include the now familiar individual cases useful for a single CD, such as for a music CD or movie DVD.

Examples of boxes where the hinged cover flips forward, and which are useful for holding flat articles such as computer discs, index cards, and the like, include boxes described in the following references; U.S. Pat. No. 4,546,898 to Ekuan; U.S. Pat. No. 4,696,397 to Nakamats; U.S. Pat. No. 4,735,309 to Nemeth; U.S. Pat. No. 4,766,999 to Kin-Shon; and, U.S. Pat. No. 4,986,415 to Posso. Of these examples, the boxes claimed in '415 (Posso) and in '999 (Kin-Shon) lean backwards when opened so as to "display" the front most flat item in a rearward tilted position. Quite different from these examples, and apparently unique, is the box claimed in the '898 patent (Ekuan) that pulls and opens forward, with a concomitant forward tilt to the contents of the box.

Forward tilting boxes may be useful for offering up items in a "dispensing" or "one-at-a-time" orientation. Most recognizable are soda can case cartons that have a wedge at the rearward edge of the bottom panel to tilt the case forward and toward the consumer so that the soda cans roll forward each time one is pulled from the carton. U.S. Pat. No. 5,289,943 to Powell claims an example of such a forward-tilted carton useful for dispensing soda cans. For dispensing flat or substantially flat articles or packages standing on their edges, some rearward-tilted cartons are known. For example, U.S. Pat. No. 4,382,526 to Stone claims a downward and rearwardly inclined carton for dispensing substantially flat articles and U.S. Pat. No. 4,433,778 to Maio et al. claims a downward and rearwardly sloping display carton. For dispensing flat objects from a forwardly-tilted container or box, there are few options to be found. One such forwardly-tilted container that appears useful for dispensing individual flat packages is disclosed by Antal et al. in U.S. Patent Application 2008/0135440. However, the Antal dispenser does not have a lid of any sort and there is no provision for ensuring the removal of only one flat package at a time from the container.

What is clear from a perusal of the literature and the marketplace is that there are no examples of a forward-tilted dispensing box useful for dispensing flat articles stacked side-by-side that also features a forward swinging, drop-down lid. Indeed, what it is entirely lacking in the market is a hinged-lid box that opens forward, and which is tilted forward such that the flat articles are leaning at the front of the box for easy removal one-at-a-time by the consumer.

SUMMARY OF THE INVENTION

The present invention is a hinged-lid dispensing box that is useful for the storage and dispensing of flat articles. In general, the box of the present invention is constructed such that when it is placed on a flat horizontal surface, the front panel will lean at least a few degrees on a forward incline. Because of this permanent forward lean, a flip-down hingably attached lid at the front of the box will necessarily "drop open" once unfastened and eased far enough for gravity to take over. The stack of flat articles within the box will necessarily lean forward, tip against and parallel to the inner surface of the front panel, staying readily accessible for the consumer. Various flanges may be added around the inside periphery of the opening of the box to promote "one-at-a-time" removal of the flat articles from the open box. The box of the present invention is useful for storing and dispensing a wide range of substantially flat articles including, but not limited to; playing cards, index/file cards, laundry treatment articles, marketing/sales cards/literature, sanitary napkins, cleaning and scrubbing pads, burnishing pads, and multimedia storage discs, and the like. It is most useful for the storage and dispensing of flat articles that have enough stiffness to stand vertically on their thin edge. So for example, the present box as such is most useful for holding a stack of stiff thin pads such as feminine pads, cleaning pads or burnishing pads that are stored dry, or index/file cards, playing cards, and multimedia storage discs, but would be less useful (or altogether useless) for the dispensing of articles that are flat but also too thin and flexible to stand up, such as facial tissues, napkins, eyeglass lens wipers, and the like. The box of the present invention may be used for rod shaped articles as well, such as drinking straws or even cigars or cigarettes with some adaptation of the angles and curvatures of the front and sides. The overall shape of the box is variable beyond the simple rectangular cuboid shape in order to accommodate articles that although relatively thin and stackable, have shape other than square or rectangular (e.g., round discs, trapezoidal yet thin sponges, wave-shaped laundry treatment nonwoven articles, etc.).

Minimally, the box of the present invention comprises in combination; a back panel; side panels; a bottom panel; a front panel; a top panel; and, a lid hinged to the front panel that forms at least a portion of both the front and top panels of the closed box, and wherein the lid drops and opens forward on at least one hingeable/pivoting connection, and wherein the front panel is angled forward from vertical at least a few degrees. In this way, stacked/flat articles loaded into the box will necessarily lean against and parallel to the inside surface of the front wall, ready for easy reach and removal one-at-a-time by the consumer. Optionally a downward/forward slanting bottom panel (or an inserted wedge), to form a near right angle to the forward leaning front panel, aids in positioning the stack of forward leaning articles most efficiently. Thus, the box minimally comprises a forward leaning front panel, although any or all of the other panels (top, back, and bottom) may lean or tilt forward/downwardly as well.

DETAILED DESCRIPTION OF THE INVENTION

Figure 1:
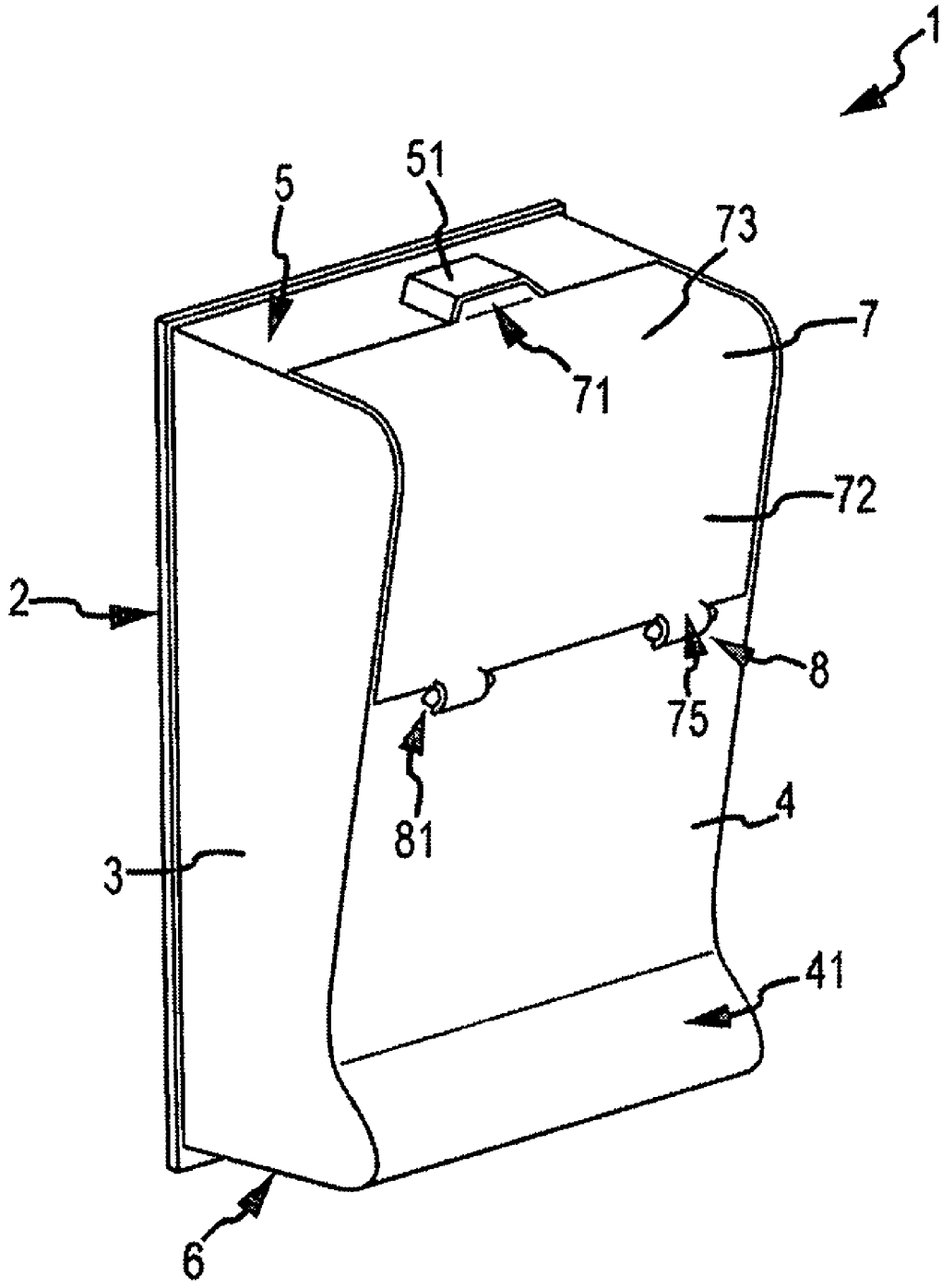
FIG. 1 represents a front perspective view of the dispensing box 1 of the present invention, with the hingeable lid 7 in its closed position.

The following description is of exemplary embodiments only and is not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims. Additionally, though described herein in general terms of a hinged lid box assembled from at least two separate parts (container body and lid) additional parts may be envisioned such as a removable back panel to reload the box, or separate hinges used to attach the lid to the container body. Furthermore, additional parts may be added to the inside of the box including features such as a spring-loaded push paddle, or dividers, or a wedge-shaped cardboard floor to help tilt the stack of flat objects forward.

The spatial orientation used herein is such that the front of the box of the present invention refers to the panel on which the lid/cover pivots to open. That is, the consumer faces the front of the box when looking at the hinged connection between the lid and the front panel. The box of the present invention is designed to be "forward leaning" (i.e. leaning toward the consumer) with the lid preferably hinged at its bottom edge onto the leaning front panel of the box. When the consumer unfastens the lid at the top of the box, the lid may "fall open" in a forward direction toward the consumer. However, the present invention is not limited as to how far the consumer must move the lid before gravity takes over to drop it open. Since there are many materials of construction with various weights, various degrees of tilt that may be designed into the box, the option of sloping the top panel downwardly, along with many design shapes for the lid giving rise to infinite centers of gravity, the lid could easily be designed to fall open entirely on its own once it's unfastened, or it may be designed to require a short forward movement by the consumer until the center of gravity of the lid passes far enough over the lid's fulcrum for gravity to drop it open the rest of the way. Of course, the consumer may be holding the box in the air at any number of forward or backward angles when he/she opens it, in which case the lid may or may not simply fall open on its own, regardless of what the design was intended to accomplish.

Some terms require defining and some are also used interchangeably herein. For example, "panel" and "wall" are meant interchangeably as substantially thin and primarily flat, rigid, structural elements that are mutually contiguous. Panels refer to what is viewed from the outside of the box, regardless of the use of any interior elements such as cardboard fillers, dividers, and the like. For example, the "bottom panel" refers to the exterior surface at the bottom of the box even though wedge-shaped cardboard fillers may be inserted inside at the bottom of the box to give tilt to the stack of flat articles therein. In other words a "false bottom" could be created by inserting wedge-shaped fillers into the box that would otherwise have a horizontal bottom panel. Additionally, wedge-shaped feet may be molded onto to the exterior of the bottom panel of the box to give tilt to the entire box, (i.e. to downwardly slope the bottom panel toward the front). "Lid" and "cover" are interchangeably used as the term for the movable portion of the box that allows access to the interior. "Rear" and "back" refer to the backside of the box when it is standing upright on a flat surface. "Body" and "container" are used interchangeably to mean the open housing created by all of the contiguous panels, minus the lid. Thus, the back, bottom, sides, front and top panels together define an open container with an interior volume and an opening through which the interior space is accessible. When the cover is attached to that open container/body and then closed, the box of the present invention is created, with that box comprising full back, bottom, sides, front and top panels.

As mentioned above, the box of the present invention may also have a removable back/rear panel. This removable panel may fasten within a frame outlined by the contiguous edges of the top, bottom and side panels. Once both the rear panel and the cover are added to the container/body portion, the shape of the complete box is revealed.

In regards to materials of construction, the box of the present invention may be constructed of various plastics, paperboard/cardboard, glass, metal, Styrofoam, or wood, or combinations of these materials, with plastic being preferred. The designs that, will be described below are preferably manufactured from plastic resins using injection molding, injection blow-molding, and/or thermoform processes. As such, the plastic resins used may include, but are not limited to, polycarbonate (PC), polyethylene (PE), polypropylene (PP), polybutylene (PB), polyethylene terephthalate (PET), polyvinyl acetate (PVA), acrylonitrile butadiene styrene (ABS), various acrylics and modacrylics, and polyvinyl chloride (PVC), and mixtures thereof. Environmentally conscious materials of construction may include starches or other water-soluble/degradable polysaccharide substances, or combinations of bio-derived polymers and synthetic plastic resins. Most preferred is to incorporate a combination of injection molded and thermoformed plastic parts. For example, a container body and lid may each be injection molded plastic parts, whereas a removable snap-fitting rear panel may be separately made from thermoformed plastic. Plastic construction allows for infinite variations of color, transparency, texture, thickness, etc. For example, the box of the present invention may have an opaque and pigmented plastic body portion combined with a clear transparent plastic lid such that the contents of the box may be visible through the lid. Also, the box may be molded such that it includes an embossed brand logo or other product identification, along with net weight/contents, use instructions, and/or safety information. Most particularly, a thermoformed rear panel may carry use instructions or other product information stamped thereon. The box may be constructed of recyclable plastics, with minimal thicknesses, in order to be low cost, lightweight, and environmentally friendly.

That being said, the box of the present invention minimally comprises in combination; a rear panel; a bottom panel; side panels (or "sidewalls"); a top panel; a forward leaning front panel; and, a forward opening cover, wherein the cover is hingeably connected to the front panel of the box from a bottom portion of the cover. As mentioned, the combination of the forward lean to the front panel and the bottom hinging cover attached thereon allows the cover to "drop open" on its own or with only a short initial movement by the consumer. Ideally the box may be opened by the consumer using one hand, for example by simply applying thumb pressure to the top portion of the lid to unfasten it. The box preferably has an overall "square cuboid" or "rectangular cuboid" shape to accommodate stacked flat sheet-like articles, however not all the angles-between panels need be true right (90°) angles. Otherwise there would be no forward lean to the invention, no stability, and certainly no aesthetic appeal. The size of the box is entirely variable. For example, it may be from about 1 inch deep by 2 inches wide by 4 inches in height to about 6 inches deep by 12 inches wide by 24 inches high, depending on what is to be stored and dispensed from the box (e.g., business cards, 3×5 inch index cards, small rectangular cleaning pads/sponges, or 18-inch diameter burnishing pads). Additionally, the box is described as having "side panels" or "sidewalls". It is important to note that this term is meant to broadly imply possibilities beyond the simple arrangement of two parallel, opposing flat side panels. For example, the entire front of the box may be curved such that any distinction between individual "side panels" becomes obscure, and the box may appear to have just have a curved front panel rather than distinct "side panels" attached to a "front panel". However, when configuring the box of the present invention to hold flat sheet-like articles, two opposing and substantially parallel flat side panels attached and contiguous to a front panel are preferred in order to give the box of the present invention an overall "rectangular cuboid" shape. These general comments are more easily understood through a discussion of the drawing figures and the numbered elements therein.

FIG. 1 illustrates a front perspective view of the forward-leaning storage and dispensing box 1 of the present invention, which comprises in combination; a rear panel 2, side panels 3, a bottom panel 6, a front panel 4, a top panel 5, and a cover 7 that together define the overall shape of a container with a movable lid having an interior space for holding various articles such as flat stiff sheets or cards. Evident from this view are the preferred configurations for the bottom panel 6, the front panel 4, and the cover 7. Bottom panel 6 as configured defines the interior "floor" of the box, and as such this bottom panel preferentially slopes downwardly toward the front of the box to merge with the front panel 4. The bottom panel 6 connects to each of the rear panel 2, the side panels 3, and the front panel 4. A "forward lean" is created by mating the bottom panel 6 with the substantially vertical rear panel 2 at an interior angle greater than 90°, and having the front panel 4 leaning forward from true vertical. In a preferred configuration, rear panel 2 is substantially vertical, and bottom panel 6 is attached to the rear panel 2 at a position higher up than the bottom edge of rear panel 2. Alternatively, wedge shaped "feet" may be used under the box when the bottom panel 6 is attached at, and contiguous with, the bottom edge of back panel 2. As shown in FIG. 1, the rear panel 2 may be used as the vertical anchor to which the forward leaning box is constructed. The rear panel may include a heavier flange (as shown) that also operates as the rear foot to the box and as a frame into which a removable panel can be snapped (for refilling the box).

Although not essential, the front panel 4 and bottom panel 6 may be at an approximate right angle to one another to best fit the right angle formed by a stack of flat articles. Alternatively the interior angle between bottom panel 6 and front panel 4 may be even greater than 90° to provide an even greater forward lean to front panel 4. Cover 7 preferably includes a frontal portion 72 having a bottom edge and a top portion 73 having a rear edge, wherein these two portions contiguously merge at close to a right angle to form a slightly curved cover. That is, in the preferred configuration, the cover 7 makes up a portion of the top and a portion of the front of the box 1 when the cover 7 is closed. The curvature of the cover 7 may compromise the interior storage capacity of the box. Indeed, when stacking flat articles within the box, a substantially curved cover 7 may hinder the ability to have the stack of flat articles lean fully against the interior side of front panel 4, depending on the height of the articles. Thus, the lid 7 may be designed to have only the curvature needed for aesthetics and manufacturability. Preferably the frontal portion 72 of cover 7 will not take up much more than about ⅓ to ½ of the front of the box 1, simply because the front panel 4 is the support for the forward-leaning stacked articles inside (discussed below). However, the dimensions for the top portion 73 of cover 7 are more variable, with this portion of the cover contributing anywhere from a small portion to essentially the entire top of the box. For example, the rear edge of cover 7 may extend so far back that the top portion 73 of the cover 7 nearly or entirely replaces the top wall 5 of the box, in which case the entire top of the box will open when the cover is opened. As will be discussed below, the cover 7 may also include part of the side panels 3 such that more of the interior of the box is accessible when the cover is opened. This feature is important if the flat objects in the box are curved rather than square or rectangular shaped and need to be moved laterally while being pulled from the box.

Also depicted in FIG. 1 is a non-limiting example of a fastening means usable to keep the cover 7 in the closed position. Such a fastening means may include a first fastening portion residing on the container body, (preferably on the top panel 5), and a second fastening portion residing, on the cover 7, wherein the first and second fastening portions reversibly couple together. For example, the first fastening portion may comprise receptacle 51 positioned on the top panel 5, and the second fastening portion may comprise a similarly dimensioned insertable tab 71 molded into the cover 7 at its rear edge that fits within the receptacle 51, such that the two fastening portions 51/71 reversibly mate to hold the cover 7 closed. Additional variations of the fastening means are numerous. For example, the first portion oil top panel 5 may simply be a raised rib and the second portion on the cover 7 may be simply a tab that snaps over the rib. As mentioned above, cover 7 may be molded in such a shape as to have a forward center of gravity, and along with the forward lean of the front panel 4 and perhaps a short portion 73 to the lid, the fastening means 51/71 may be all that keeps the lid from falling open. The tab 71 may be configured to snap over a lip, ridge or protrusion configured on top panel 5 rather than designed to insert into a recess 51.

Still referring to FIG. 1, one way to have the box forward leaning yet still have stability is to configure a protrusion or front "foot" 41 contiguous with the bottom panel 6 and front panel 4. With a removable rear panel 2 and cover 7 as separate parts, it is possible to injection mold the container/body as a complete and contiguous plastic housing, with such part comprising the side panels 3, the bottom 6, front 4 (with foot 41) and the top 5. This complete part would pull out of a plastic injection mold. Of course, the foot 41 creates interior dead space at the bottom front of the box. However, it adds stability and some aesthetics.

Also seen in FIG. 1 are the hinges 8 that may be used to hingeably connect the lid 7 to the front panel 4. In a simple embodiment, the hinges 8 may be comprised of posts 81 integrally molded as part of the front panel 4, and "C-shaped" tabs 75 that are integrally molded at the bottom edge of, and as a contiguous part of, the cover 7. To form the hingeable connection, the curved tabs 75 may be snapped over the posts 81 allowing the cover 7 to hingeably pivot forward on the posts 81. It is important to note that only one specific, non-limiting example of a moveable fastening between cover 7 and front panel 4 is shown in FIG. 1. There may be only one hinge rather than two, or more than two. There could be a "living hinge", which is commonly known to be a thinner, contiguous and pliable region of material on which two portions can move relative to one another. For a living hinge, a thin, pliable region of plastic may be incorporated and contiguously molded between cover 7 and front panel 4, allowing the cover 7 to open/close through bending in this pliable region of plastic. Or there could be a slot horizontally positioned along the top of the front panel, 4 where a rod-shaped bottom edge of the cover 7 may slide into, forming one large hinge. Of course, the hinge(s) may be entirely separate pieces and not molded into either the cover or the front panel. In that case the hinges 8 may be fastened with rivets, sonically welded, or glued, both to the cover 7 and front panel 4.

Figure 2:
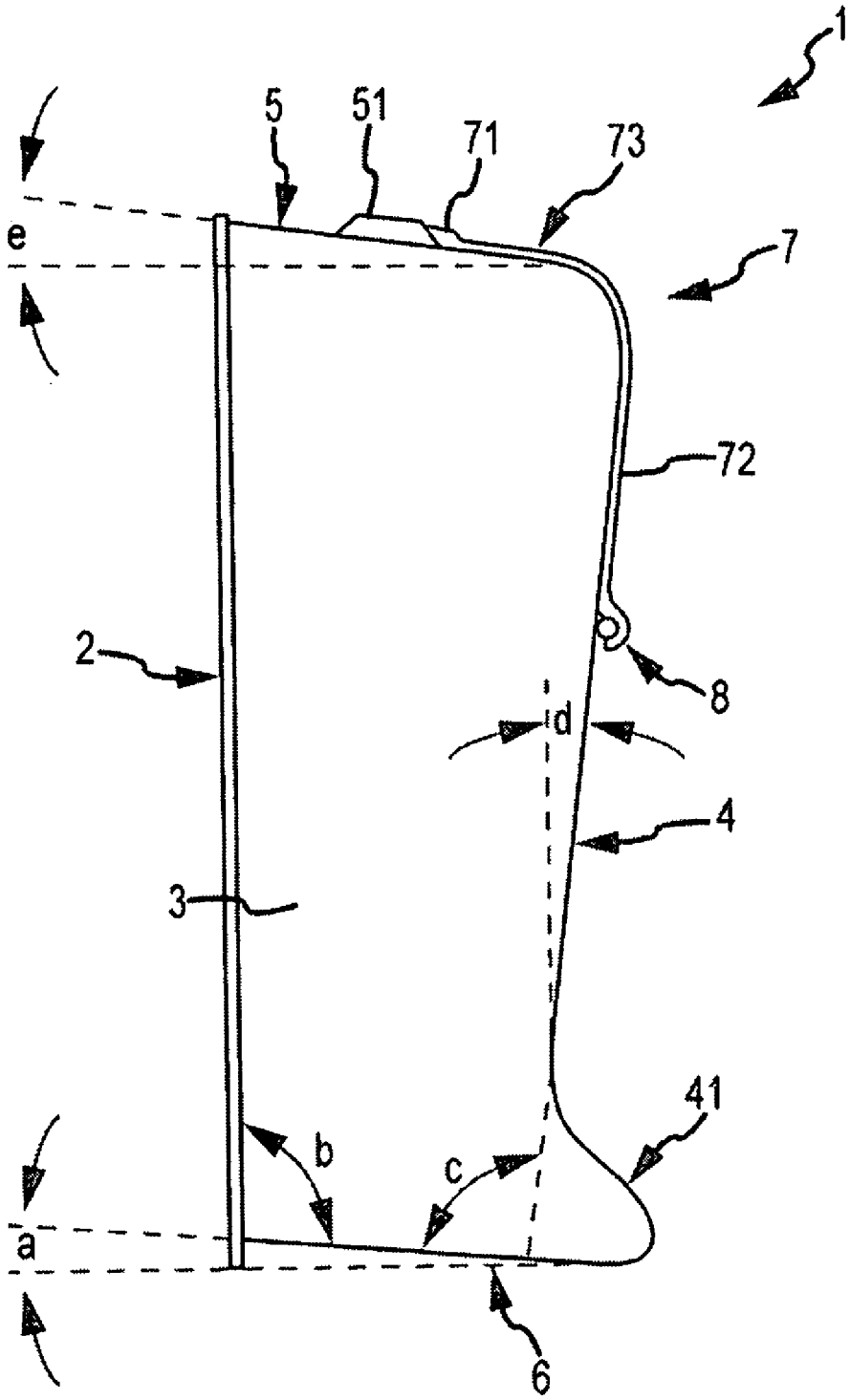
FIG. 2 represents a side elevation view of the box 1 of the present invention showing the preferred angles at which box 1 leans forward.

FIG. 2 depicts the side elevation view of a preferred embodiment of the present invention comprising a substantially vertical back panel 2, sidewall 3, forward/downward sloping bottom panel 6, top panel 5, front panel 4 and cover 7. More clearly depicted in this side plan view is the forward lean of the box, achieved through the downward slope of bottom panel 6 and forward lean of front panel 4. The angles between the panels include the angle "a" along which the bottom panel 6 slopes from horizontal. The sloped bottom may also be measured by the internal angle "b" created in the interior of the box between the bottom panel 6 and the rear panel 2. As mentioned, the angle "c" is the interior angle between the bottom panel 6 and the front panel 4, which is not critical. It may be close to 90° to conform to the right angle of a stack of flat articles, or several degrees smaller or larger than a right angle. The forward lean to the front panel 4 is measured by the angle "d", which is the angle at which the front panel 4 leans forward from true vertical. The top panel 5 may slope downward at an angle "e" toward the front of the box as well. Though not critical, the slope "e" contributes to the ease at which the cover 7 drops open when the fastening arrangement 51/71 is uncoupled. Additionally, the angle "e" helps build in more interior space in the top rear portion of the box, allowing for a greater number of stacked flat articles to fit back within the interior of the box, while still remaining parallel to the inside of front panel 4. In one configuration, top panel 5, front panel 4 and bottom panel 6 may all be at close to right angles to one another to best accommodate a leaning stack of flat articles. In yet another configuration, top panel 5 may form a near right angle to front panel 4, but angle "c" may be greater than 90°. The forward extension of foot 41 may be increased to balance the box if angle "d" is substantially large from vertical (e.g. about 30° or more). As mentioned, a large foot 41 may be molded as part of the container housing provided a removable back cover is also utilized. In that way the mold can be pulled out from the open backside of the housing comprised of bottom 6, side panels 3, front panel 4, front foot 41, and top panel 5.

That being said, angle "a" is preferably from about 2° to about 15° inclined from horizontal, and most preferably from about 3° to about 8°. The preference for angle "a" drives "b" by simple geometry provided rear panel 2 is substantially vertical. Thus the most preferred interior angle between bottom panel 6 and rear panel 2 is from about 93° to about 98°. The forward lean of front panel 4, as measured by angle "d", is from about 2° to about 15° from vertical. The most preferred angle "d" is from about 3° to about 8°. The downward slant of the top panel 5 of the box, as, measured by angle "e", is preferably between about 0° (no slant) to about 15°. More preferred is to incorporate a downward slant to the top of the box at from about 5° to about 15°, and most preferred is to slant panel 5 at about 7-10° from horizontal.

Figure 3:
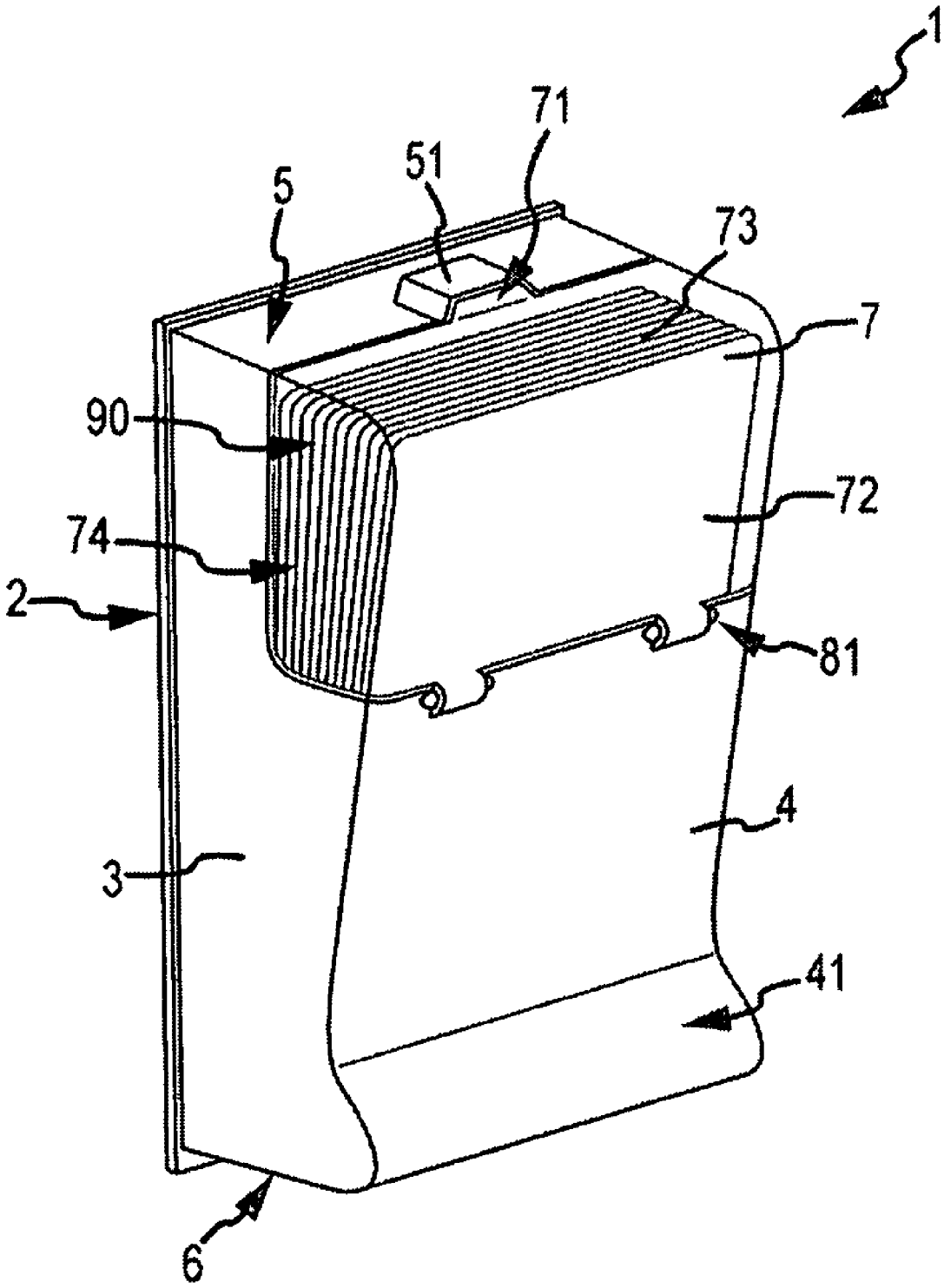
FIG. 3 represents a front perspective view of another embodiment of the dispensing box 1 of the present invention comprising a transparent hingeable lid 7 that includes front 72, top 73, and side 74 portions, with a stack of flat articles 90 visible therein.

FIG. 3 depicts a front perspective view of a more preferred embodiment of the box 1 of the present invention. In this version, the cover 7 comprises a side portion 74 in addition to the top portion 73 and front portion 72 discussed above. The purpose for having the cover 7 infringe into the side panels 3 of the box 1 is to have greater access to the contents of the box when the cover 7 is flipped open. If the flat articles are curve shaped (rather than square or rectangular), the open sides of the box allow the consumer to move each sheet-like article laterally to either side while removing it from the box. Unlike square or rectangular flat articles that may be pulled straight up and out of the box, curved articles may require more maneuvering by the consumer to affect their removal, and this required motion may be side-to-side. FIG. 3 is depicted with a preferred transparent cover 7 such that the stacked sheet-like articles 90 in the box remain visible. As illustrated, the stack of articles 90 preferably lean forward with the front-most sheet up against the inside surface of front panel 4 and the remaining sheets stacked neatly behind the lead one. As discussed above, the slope given to top panel 5 along with a sharper angle between cover portions 72 and 73, allow for a greater number of stacked flat articles to be placed inside the box.

Figure 4:
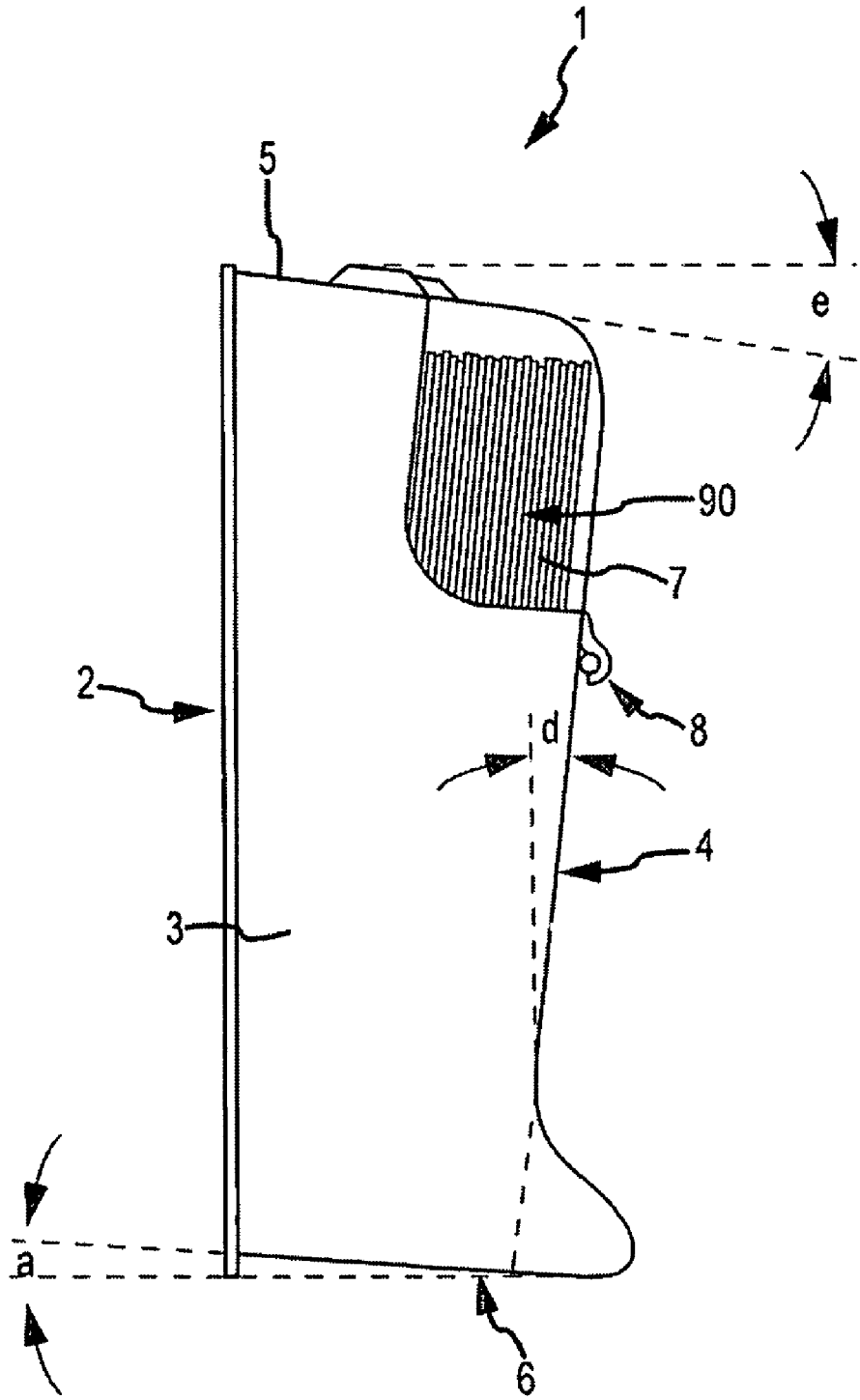
FIG. 4 represents a side elevation view of another embodiment of the dispensing box 1 of the present invention comprising a transparent hingeable lid 7 that includes front 72, top 73, and side 74 portions, with a stack of flat articles 90 visible therein.

FIG. 4 depicts the side elevation view of a more preferred embodiment of the box 1 of the present invention wherein the cover 7 includes side, top and front portions in order to provide greater accessibility to the contents 90 when the cover is opened, and to provide both stability to the cover and some pleasing aesthetics. The embodiment depicted includes a substantially vertical rear panel 2, along with a forward leaning front panel 4 and forward/downwardly sloping bottom panel 6. As mentioned, the angle "d" to which the front panel 4 leans forward is preferably from about 2° to about 15° from vertical. Also as mentioned, angle "a", the angle at which the bottom panel 6 slopes downwardly forward is preferably from about 2° to about 15° from horizontal, and most preferably from about 3° to about 8°. Lastly, the top panel 5 is preferably slanted downwardly at angle "e" as shown at from about 0° to about 15°, and most preferably at about 7-10° from horizontal. Contents 90 are also visible and viewable through the preferred transparent cover 7. The stack of substantially flat, sheet-like articles 90 preferably lean against and parallel to the inside surface of front panel 4. Cover 7 is pivotally connected to front panel 4 through hinge(s) 8, and once the cover 7 is flipped open, the contents 90 become accessible to the consumer.

Figure 5:
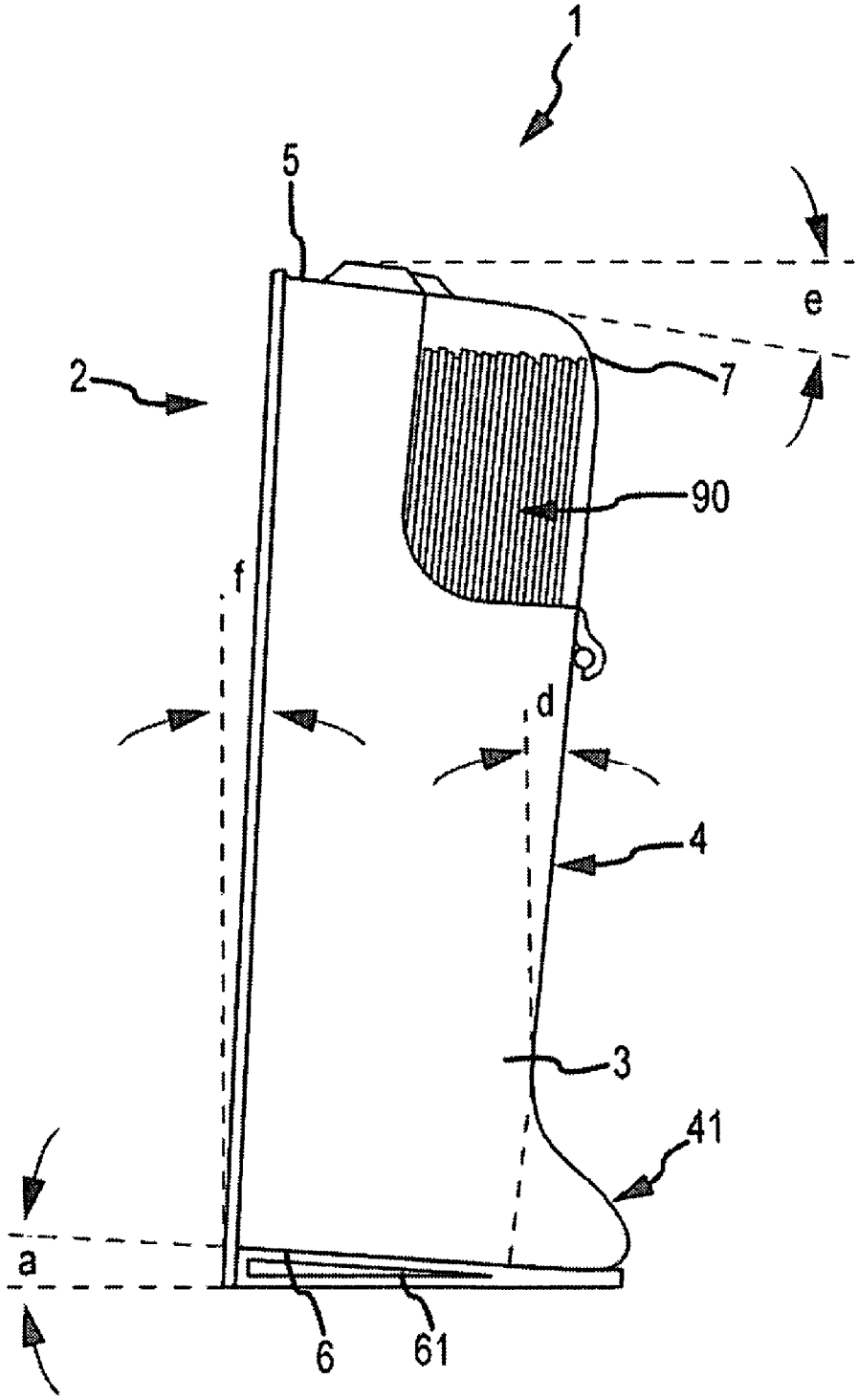
FIG. 5 represents a side elevation view of another embodiment of the dispensing box 1 of the present invention wherein the both the front panel 4 and rear panel 2 panel lean forward from vertical, and wherein the bottom panel 6 and top panel 5 slope downwardly toward the front of the box.

FIG. 5 depicts the side elevation view of another preferred embodiment of the box 1 of the present invention wherein rear panel 2 and front panel 4 both lean forward, and wherein both top panel 5 and bottom panel 6 both slope downwardly toward the front of the box. This embodiment demonstrates that rear panel 2 does not necessarily need to be vertical. As illustrated in FIG. 5, Angle "f" is preferably from about 0° to about 15° from vertical, which may be close to the angle "d" to which the front panel 4 preferably leans. It is important to note that angles "d" and "f" need not be identical, as is certain for an embodiment comprising a substantially vertical rear panel 2 and forward leaning front panel 4. If these angles are the same, the front panel 4 and rear panel 2 are necessarily parallel and the box 1 will more efficiently hold the stack of articles 90 without wasted interior space. Stability may be gained through use of the molded forward foot 41 as discussed above. Additionally this preferred embodiment uses an exterior bottom foot (or at least two feet) 61 to support the box 1 on its forward lean of from about 2° to about 15°, shown by angle "a". Indeed, the embodiment represented in FIG. 5 is very similar to a substantially rectangular cuboid box tilted forward through use of an exterior wedge foot (or feet) 61. Foot (or feet) 61 may be molded contiguously with the bottom panel 6, or instead may be separate part(s) that are glued or otherwise fastened to the bottom of the box. As shown, the top panel 5 may be sloped downward at angle "e" as prior embodiments. The downward slant of the top panel 5, as measured by angle "e", is preferably between about 0° (no slant) to about 15° from horizontal. Of course, angles "a" and "e" may be identical, but do not necessarily need to be.

Figure 6:
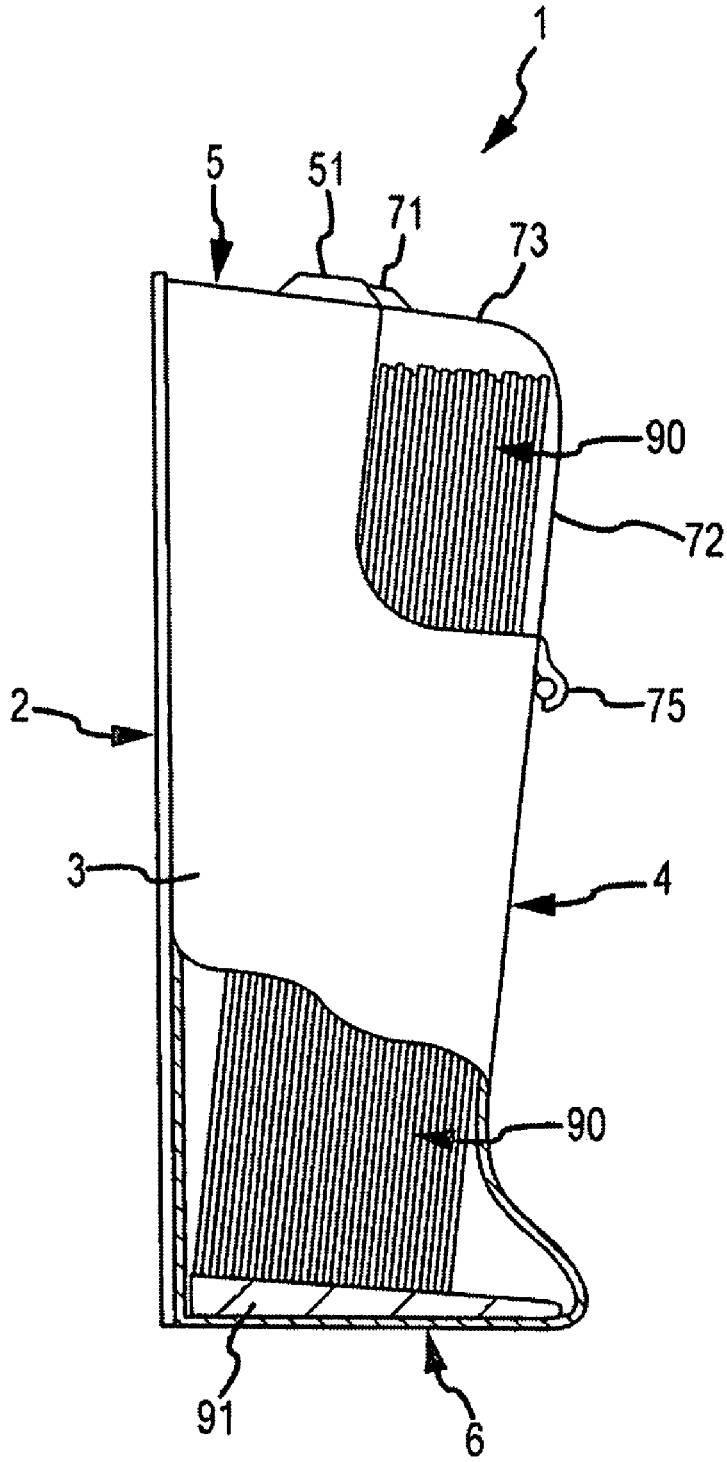
FIG. 6 represents a "cut away" side elevation view of another embodiment of the dispensing box 1 of the present invention comprising a substantially horizontal bottom panel 6 and wedge-shaped structure 91 usable to create a forward-sloping inner bottom surface.
Figure 7:
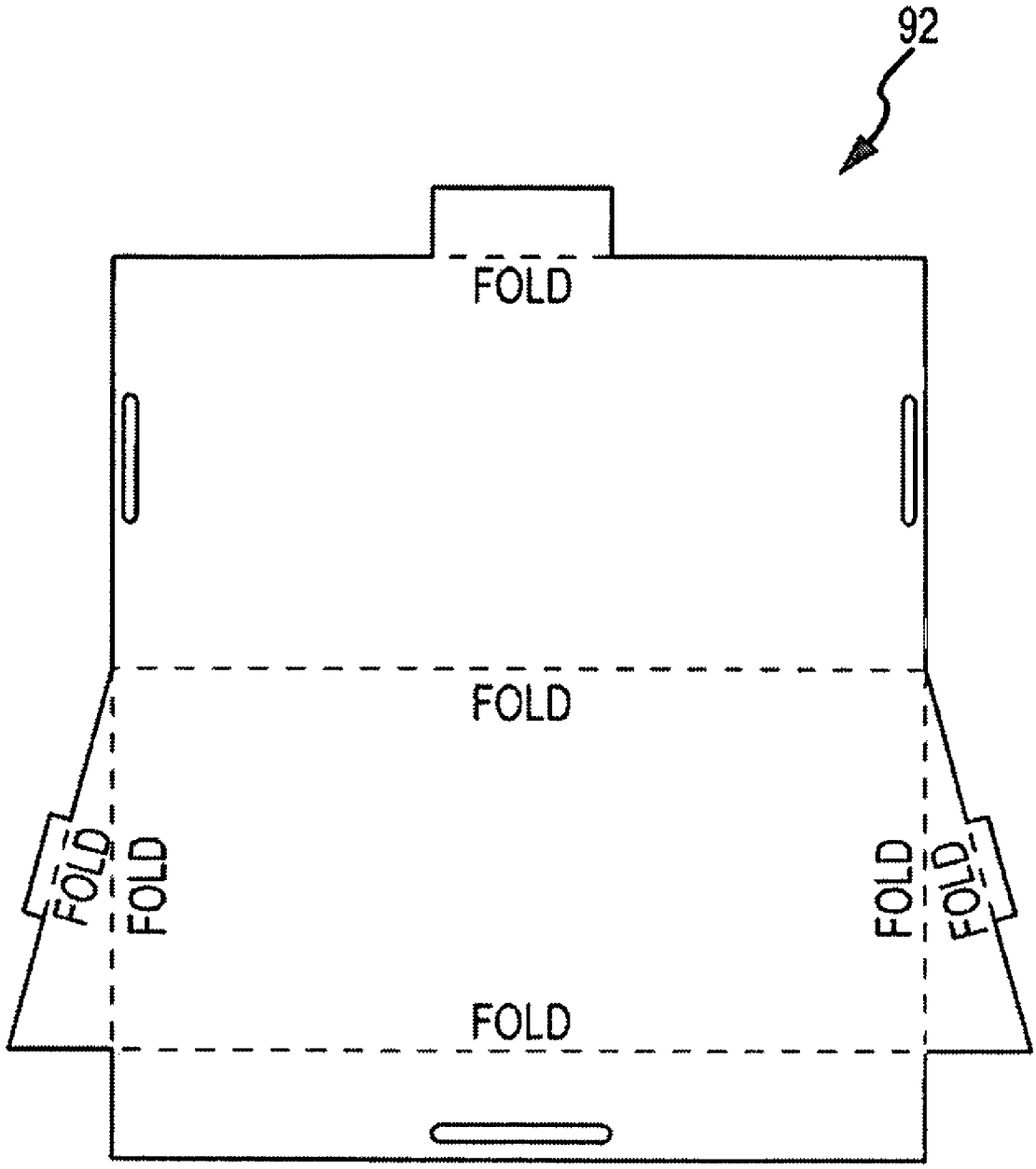
FIG. 7 represents a cardboard blank 92 that may be folded up as illustrated to create a wedge-shaped structure 91 that may be inserted in the box 1 to create a forward-sloping inner bottom surface.

FIG. 6 depicts a cutaway side elevation view of another embodiment of the box 1 of the present invention that comprises a substantially vertical rear panel 2 molded at a near right angle to a substantially horizontal bottom panel 6. As mentioned, the box of the present invention minimally comprises a forward leaning front panel 4, preferably leaning at from about 2° to about 15° from vertical. However, in this embodiment, the stack of flat, sheet-like articles 90 may be made to lean forward against the inner surface of front panel 4 simply by incorporating a suitably dimensioned wedge structure 91 inside at the bottom of the box. Although the box may be molded with a flat and horizontal bottom, the wedge 91 provides an angled floor for the forward leaning stack of articles 90. The simple wedge 91 is preferably made from folded cardboard, Styrofoam, wood or molded plastic. The wedge 91 may be loose, or glued or otherwise affixed in the box, against the bottom panel 6. Alternatively it may be removable and/or disposable, and may be included along with a refill stack of articles 90. Ideally, the wedge 91 is comprised of a cardboard blank included in the refill package of articles 90. The consumer may fold up the blank to create the wedge 91, and then insert it into the box, followed by the refill stack of articles 90. The wedge 91 preferably makes a right angle to the forward leaning front panel 4. Thus, where the preferred lean of panel 4 is from about 2° to about 15° from vertical, the wedge 91 may be from about 2° to about 15° from horizontal, and dimensioned to fit the width and depth of the box. A fold-up cardboard wedge is also an ideal place to hide a desiccant (such as a silica gel packet) that may be used to desiccate and/or preserve the contents 90 of the box. Or a fragrance sachet may be hidden inside the wedge structure 91 to continually add fragrance to the stack of flat articles 90. A novel embodiment for a refill pack of articles 90 may include the cardboard blank as a panel on the refill packaging that the consumer cuts out with scissors and folds up to create the wedge 91. FIG. 7 illustrates a simple cardboard blank 92 that may be folded up to provide the wedge structure 91 for use within the box of FIG. 6.

Figure 8:
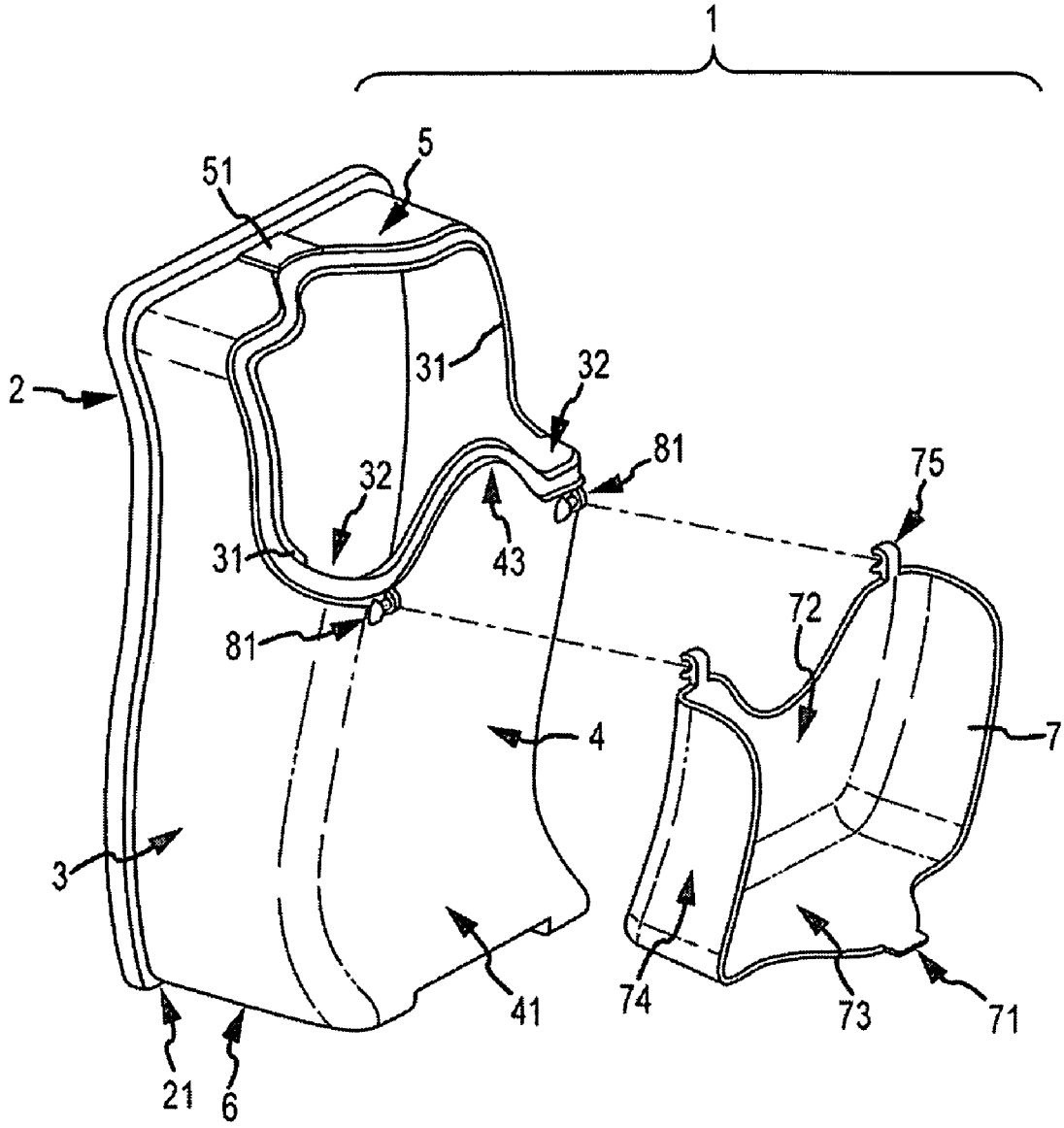
FIG. 8 represents a front perspective view of a preferred embodiment of the dispensing box 1 of the present invention with hingeable lid 7 shown detached from the container body, wherein a flange 31 circumscribing the opening of the box 1 is visible.

FIG. 8 depicts a front perspective view of a more preferred embodiment of the box 1 of the present invention with cover 7 removed from its hinges and with dotted lines showing the alignment to fasten the cover 7 to the container body of the box. This particular embodiment of the box is "wave-shaped" to best accommodate a stack of "wave-shaped" flat articles. This embodiment comprises a cover 7 that further includes side portions 74, top portion 73 and front portion 72 such that the cover 7 will contribute to portions of the front 4, top 5 and sides 3 of the completed box. The cover 7 may also include the tab 71 that may be inserted into the receptacle/slot 51 positioned on the top 5 of the box to fasten the lid in the closed position. The hinges may comprise "C-shaped" hooks 75 molded into the cover 7, along with pins 81 molded on the front panel 4 of the box. As commonly seen in plastic hinged-lid boxes of all sorts (pin box, pill box etc.), the hooks 75 are dimensioned and configured to properly snap over and pivot around the pins 81 molded as part of, and protruding from, the front panel 4. The forward leaning front panel 4 features both the molded-in foot 41 for overall anti-tilt stability (discussed above), along with a vertically elongated portion 43 that provides additional height to the inner surface of panel 4 for the stack of articles to lean against (and added aesthetics). In this embodiment, the bottom panel 6 is angled downward to the front of the box, with such angle achieved through attachment of panel 6 at a point higher up than the trite bottom edge 21 of the rear panel 2. This embodiment also includes a 1-3 mm wide inner flange 31 running internally along the edge of most of the contoured opening of the box, but cut short about 1-10 mm at the front of the box at both sides, shown as gaps 32. With "wave-shaped" flat articles dispensed from a "wave-shaped" box, this interrupted flange 31 ensures that only one sheet may be removed from the box at a time. This is because a wave-shaped article within a wave-shaped box such as depicted in FIG. 8 needs to be moved laterally to one side when lifting upwards in order to get the curved article past the similarly curved side of the box. These gaps 32 in the flange 31 provide a narrow slot that only one sheet can be maneuvered through at a time. Even with a substantially cuboid box used in dispensing square or rectangular flat articles, a flange such as 31 with gaps 32 may still be useful in ensuring that only one sheet may be removed at a time. Of course, the widths of the gaps 32 are adjusted depending on the approximate width/thickness of one of the flat sheet-like articles to be dispensed. For file cards, computer discs, CD's, cleaning or burnishing pads, and similar stacked substantially flat articles to be dispensed one-at-a-time from the box 1, the gaps 32 are preferably from about 1 to about 10 mm wide.

Figure 9:
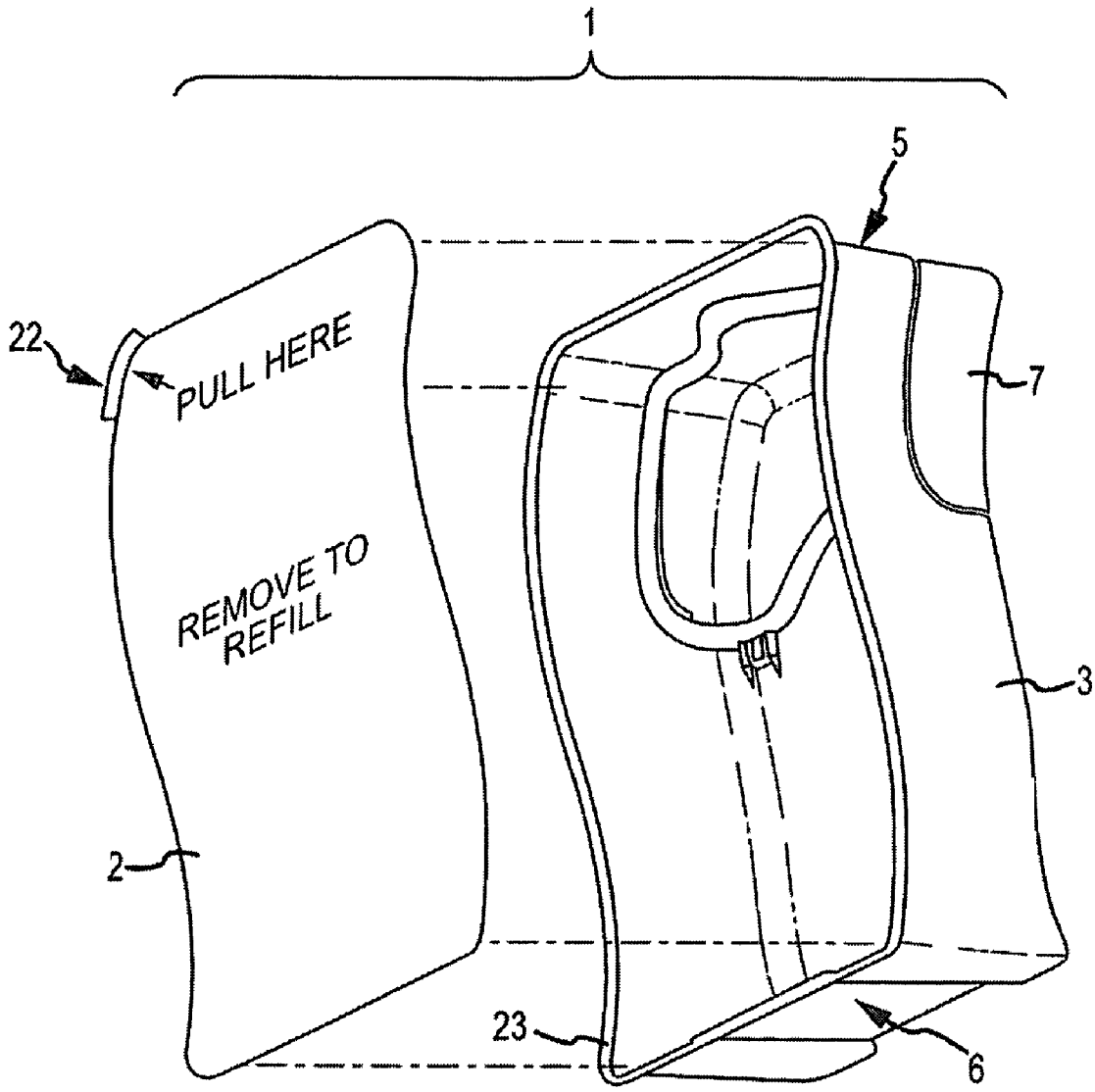
FIG. 9 represents a rear perspective view of a preferred embodiment of the dispensing box 1 of the present invention comprising a removable back panel 2 shown detached from the container body.

FIG. 9 depicts a rear perspective view of a most preferred embodiment of the box 1 of the present invention showing a removable rear panel 2. As mentioned, the purpose for incorporating a removable rear panel 2 is three-fold. First, a removable panel allows the box to be refilled with a new stack of articles to be dispensed. In this way, the box 1 may be provided to the consumer pre-filled as a "starter kit", and the consumer subsequently buys only refill stacks that may be provided in less-expensive packaging (e.g. shrink wrapping). Second, a removable rear panel ensures that the container body, (the portion of the box without the rear panel or the cover), can be manufactured/molded as a single piece in an injection molding operation. That is, the housing comprised of the side panels 3, the top 5, the bottom 6 and the front 4 may be injection-molded as a single plastic part, despite curvatures. Third, the removable rear panel 2 may be stamped in a thermoform operation, reducing cost and overall weight of the box and allowing for instructions and/or other verbiage to be easily embossed thereon. In the most preferred arrangement, the box 1 is an assemblage of three parts: the container body (in combination: the side panels 3, top panel 5, bottom panel 6 and front panel 4); the cover 7; and, the removable rear panel 2. As shown in FIG. 9, the rear panel 2 may also include a tab 22 to enable gripping and removal from the box. The rear panel 2 is necessarily dimensioned such that it snap-fits snuggly into a lip or frame 23 that is formed from the edges of the contiguous sides, top and bottom panels. FIG. 9 shows with dashed lines the alignment of a fully removable rear panel 2 with the frame 23 that the panel 2 fits into. Of course, the rear panel 2 may be hinged to the remainder of the box rather than completely removable from it, in which case it is best described as a "rear door". The rear panel 2 may still be a separate the thermoformed plastic panel, but may be fastened to the remainder of the box through a suitable hinge or hinges (e.g. similar to hinges 8 used for the cover). Alternatively, the rear panel may be hingeably attached to the remainder of the box through a molded and contiguous living hinge. If hinged, the rear panel may be connected to the remainder of the box at either one of the two sides, at the top or at the bottom. The easiest access to the interior of the box for loading a new stack of flat articles is likely to be through a rear door that hinges either at its bottom edge or its top edge.

Figure 10:
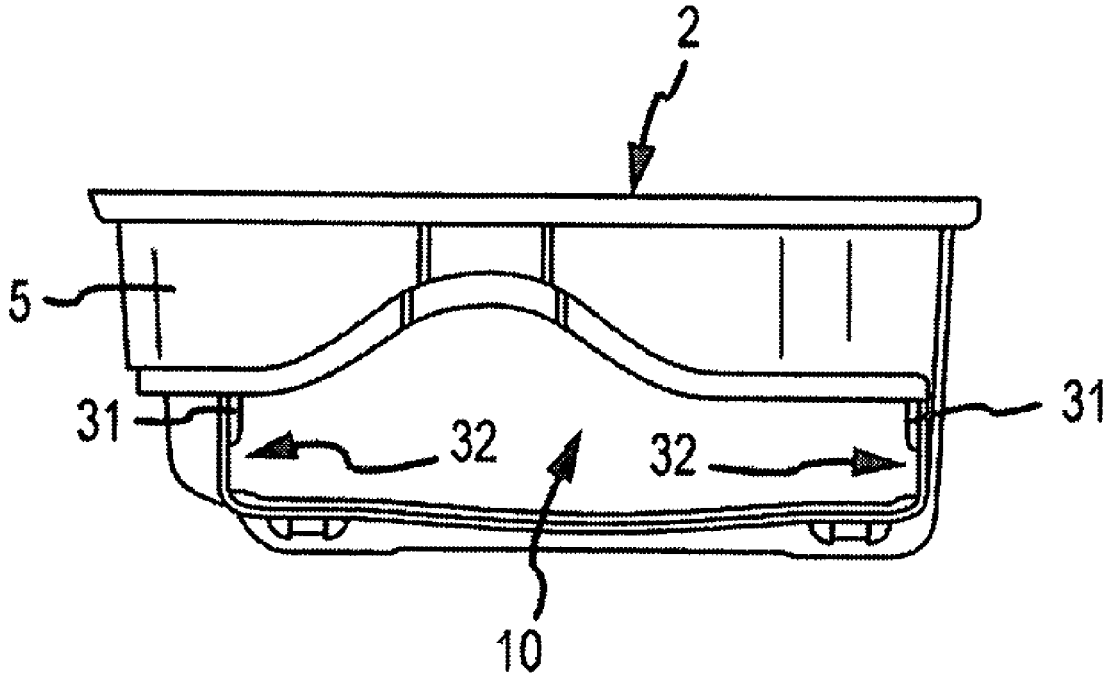
FIG. 10 represents a top plan view of a preferred embodiment of the dispensing box 1 of the present invention, (with lid removed for clarity), wherein a discontinuous flange 31, usable to promote one-at-a-time article dispensing, is shown circumscribing the opening to the box 1.

FIG. 10 illustrates a top plan view of a most preferred embodiment of the box 1 of the present invention, (with the cover 7 not illustrated for clarity). Looking down onto the top of the dispensing box 1 in this illustration, the opening 10 to the box is shown, along with flange 31 that circumscribes most of the opening. As mentioned, flange 31 is preferably discontinuous, ending short at each side of the opening 10 by 1-10 mm wide gaps 32, together which provide for one-at-a-time dispensing of the flat articles from the box. Most importantly, flange 31 (e.g. about 1-3 mm in width) narrows the width of the opening 10 at each side of the box, making it easier for the front most article to be removed through the wider part of opening 10, which is across where the gaps 32 reside. In other words, the flange 31 narrows the opening 10 to the box, which impedes the removal of the flat articles. A wider opening is provided toward the front of the box by ending the flange 31 short on each side by a gap 32. The flat articles are thus more easily removed through this wider area provided in the opening to the box. As mentioned, depending on the thickness of any one of the flat articles to be dispensed, the width of the gaps 32 are adjusted accordingly such that they approximate the thickness of one article.

We have thus described a unique storage and dispensing box useful for stacked flat articles that minimally comprises a forward leaning front panel and a drop-down cover hinged thereon. This storage and dispensing box is specially designed to encourage the removal of only one flat article at a time, with the remaining stack of articles continually moving forward to fill the space created by the removed article.

We claim:

1. A box for dispensing flat sheet-like articles comprising in combination;

a. a reversibly attachable and removable rear panel;

b. a bottom panel extending forward from said rear panel;

c. side panels joining said rear and bottom panels;

d. a front panel joining said side panels and said bottom panel, said front panel leaning forward at an angle from vertical;

e. a top panel joining said rear and side panels, all said panels forming a container body with an interior space for holding a stack of flat sheet-like articles, said body having an opening;

f. a cover to close said opening, said cover minimally comprising contiguous front and top portions, said front portion including a bottom edge of said cover and said top portion including a rear edge of said cover;

g. at least one hinge attached between said front panel and said bottom edge of said cover such that the cover flips downward to open forwardly; and h. a foot at the front of said box, said foot molded contiguously as part of said bottom panel and said front panel, wherein said rear panel is substantially vertical and said front panel is leaned forward from vertical at from about 2 to about 15 degrees;

said bottom panel slopes downwardly from said rear panel to said front panel at an angle of from about 2 to about 15 degrees from horizontal;

said bottom panel and said front panel meet to form substantially a right angle; and, said bottom panel is attached to said rear panel at a position higher up than a bottom edge of said rear panel.

* * * * *